US006494570B1

(12) United States Patent
Snyder

(10) Patent No.: US 6,494,570 B1
(45) Date of Patent: Dec. 17, 2002

(54) CONTROLLING GLOSS IN AN OFFSET INK JET PRINTER

(75) Inventor: Trevor J. Snyder, Newberg, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/000,345

(22) Filed: Dec. 4, 2001

(51) Int. Cl.[7] ..... B41J 2/01
(52) U.S. Cl. ..... 347/103
(58) Field of Search ..... 347/103

(56) References Cited

U.S. PATENT DOCUMENTS 5,389,958 A 2/1995 Bui et al. ..... 347/103
5,623,296 A * 4/1997 Fujino et al. ..... 347/103
5,805,191 A 9/1998 Jones et al. ..... 347/103
6,196,675 B1 3/2001 Delly et al. ..... 347/103

* cited by examiner

*Primary Examiner*—John Barlow
*Assistant Examiner*—Michael S Brooke
(74) *Attorney, Agent, or Firm*—Philip T. Virga

(57) ABSTRACT

An application system is described for applying a two-step transfer and fusing process in an ink jet based imaging system whereby an ink image is applied onto an intermediate transfer surface and then transferred to a receiving substrate, followed by an independent secondary fuser. The secondary fuser operates at one or more temperatures for processing the receiving medium having means for holding the final receiving substrate thereby allowing extending dwell times for increased cooling capabilities for facilitating hot fusing temperatures beyond the cohesive failure temperature of the ink.

20 Claims, 2 Drawing Sheets

CONTROLLING GLOSS IN AN OFFSET INK JET PRINTER

CROSS REFERENCE TO RELATED APPLICATIONS

Attention is directed to copending applications Ser. No. 10/000,336, filed herewith, entitled, "Continuous Transfer and Fusing Application System" and Ser. No. 10/000,339, filed herewith, entitled, "Controlling Transparency Haze using a Soft Drum." The disclosure of these references are hereby incorporated by reference in their entirety.

FIELD OF INVENTION

The present invention relates generally to an imaging process. More specifically, a method for controlling the gloss on a printed image in a solid ink jet printer is disclosed. More specifically, the method applies to a two-step transfer and fusing process whereby in a first step a hot melt ink is applied onto an intermediate transfer surface and then transferred to a receiving substrate for creating an initial matte print image. This is followed by a fuse process wherein by changing the temperature and/or the dwell time and/or the nip pressure of the fuse operation, the gloss on the print image is changed.

BACKGROUND OF THE INVENTION

For printing in a solid-ink printer, the simplest method of producing an output image is to propel droplets of ink onto a piece of paper to directly print the image onto the paper, i.e., a process known as direct printing. However, direct printing has many disadvantages. First, the head to paper gap must be adjusted for different media in order to control drop position. Second, there is the well-known paper hand-off problem between the rollers that guide the paper, because of the large size of the head. Third, there is a concern that head reliability will decrease because the paper is near the head. Also, to maximize print speed, many direct print architectures deposit the image bi-directional, which introduces image artifacts and color shifts. These problems are addressed with an offset, or indirect printing process. In this process, the ink is first applied to a rotating drum or other intermediate support surface and then transfixed off onto the paper wherein the ink goes on hot and then is fused. Therefore, a single drum surface transfers the image, spreads the ink droplets, penetrates the ink into the media, and controls the topography of the ink to increase paper gloss and transparency haze.

The process requires a delicate balance of drum temperature, paper temperature, transfix load, drum and transfix roller materials and properties thereof in order to achieve image quality. These combined requirements reduce the drum material possibilities mainly due to wear of weaker materials, which result in gloss and haze degradation. For most applications, a certain amount of gloss on a print is desired, but for some applications it is desirable to obtain either a very fine matte finish or a gloss finish. Unfortunately, the printer typically has to be designed around a single gloss finish that may be adequate for the typical users needs, but not for obtaining different gloss finishes. There are also undesired print and image quality trade-offs, which must be made when optimizing a printer for customer usage. For instance, between good gloss versus good image transfer.

To solve some of the above stated problems, ink jet printing systems have utilized intermediate transfer ink jet recording methods, such as that disclosed in U.S. Pat. No. 5,389,958 entitled IMAGING PROCESS and assigned to the assignee of the present application (the'958 patent) is an example of an indirect or offset printing architecture that utilizes phase change ink. The intermediate transfer surface is applied by a wicking pad that is housed within an applicator apparatus. Prior to imaging, the applicator is raised into contact with the rotating drum to apply or replenish the liquid intermediate transfer surface.

Once the liquid intermediate transfer surface has been applied, the applicator is retracted and the print head ejects drops of ink to form the ink image on the liquid intermediate transfer surface. The ink is applied in molten form, having been melted from its solid state form. The ink image solidifies on the liquid intermediate transfer surface by cooling to a malleable solid intermediate state as the drum continues to rotate. When the imaging has been completed, a transfer roller is moved into contact with the drum to form a pressurized transfer nip between the roller and the curved surface of the intermediate transfer surface/drum. A final receiving substrate, such as a sheet of media, is then fed into the transfer nip and the ink image is transferred to the final receiving substrate.

To provide acceptable image transfer and final image quality, an appropriate combination of pressure and temperature must be applied to the ink image on the final receiving substrate. U.S. Pat. No. 6,196,675 entitled APPARATUS AND METHOD FOR IMAGE FUSING and assigned to the assignee of the present application (the'675 patent) discloses a roller for fixing an ink image on a final receiving substrate. The preferred embodiment of the roller is described in the context of an offset ink jet printing apparatus similar to the one described in the'958 patent. In this embodiment, an apparatus and related method for improved image fusing in an ink jet printing system are provided. An ink image is transferred to a final receiving substrate by passing the substrate through a transfer nip. The substrate and ink image are then passed through a fusing nip that fuses the ink image into the final receiving substrate. Utilizing separate image transfer and image fusing operations allows for faster print speeds and improved print and image quality. For example, improved image fusing and improved image transfer efficiency and/or the ability to use reduced pressures, whereby the load on the drum and transfer roller is reduced.

This imaging architecture can be manipulated to serve a number of different markets. This is done through drum and motor sizing, increasing the number of printheads, and increasing the number of printhead nozzles, etc. Lower cost and lower speed printers could be designed for the consumer market, faster network business printers are possible, and very high speed production printers are also possible. However, the 2-step architecture with a separate transfer and fusing steps is particularly advantageous in the upper print speed arena due to its relatively simple operation with very high throughput. 100 ppm to 200 ppm printers are entirely possible. In this environment the customer becomes sensitive to a number of print and image quality attributes that might not be as important or specific in the consumer or business market. For example, low graininess, color quality, color consistency, and image durability are all important. Of equal importance in this arena is the level of image gloss. A high-end solid-ink product such as this must compete with other technologies such as the age-old offset lithography process (which has high gloss) and electrophotography (which typically has medium to low levels of gloss). Aside from trying to achieve the gloss that can be produced by any particular marking technology, there is the desire from the customer from different levels of gloss. There is simply an endless array of customers and customer applications. For example, advertisements, mailers, product documentation, books, and magazines. All of these different customers and customer applications can have different requirements for gloss. Therefore, what is needed is a process that could change the level of gloss without requiring a new mechanism or drastically different print process due to the high costs and complexity involved. By using an intermediate transfer surface and separating the transfer and fusing operations and by changing the temperature and/or the dwell time and/or the nip pressure of the fuse operation, the gloss on the print image can be changed. The present invention addresses this issue.

SUMMARY OF THE INVENTION

It is an object of the present invention to provide an improved imaging system which allows high quality gloss on a variety of media wherein the image is transferred and fused in serial which allows the fastest possible print speed.

It is another object of the present invention to provide an improved imaging system utilizing an intermediate transfer surface for producing a matte finish and a downstream fuser that is capable of operating at different temperatures and/or dwell times and/or nip pressures in order to produce a desired gloss finish.

It is yet another objective of the present invention to provide an indirect printing system for applying a compliant surface that increases the reliability of the printer, decreases the noise, decreases the cost of the release agent system and achieves improved print and image quality.

Accordingly, an application system is described for applying a two-step transfer and fusing process in an ink jet based imaging system whereby an ink image is applied onto an intermediate transfer surface and then transferred to a receiving substrate, followed by an independent secondary fuser. The secondary fuser operates at one or more temperatures and/or one or more pressures and/or one or more fusing speeds for processing the receiving medium having means for holding the final receiving substrate thereby allowing extending dwell times for increased cooling capabilities for facilitating hot fusing temperatures beyond the cohesive failure temperature of the ink.

Still other aspects of the present invention will become apparent to those skilled in this art from the following description wherein there is shown and described a preferred embodiment of this invention by way of illustration of one of the modes best suited to carry out the invention. The invention is capable of other different embodiments and its details are capable of modifications in various, obvious aspects all without departing from the invention. Accordingly, the drawings and descriptions will be regarded as illustrative in nature and not as restrictive. And now for a brief description of the drawings.

BRIEF DESCRIPTION OF THE DRAWINGS

The objects, features and advantages of the invention will become apparent upon consideration of the following detailed disclosure of the invention, especially when it is taken in conjunction with the accompanying drawings wherein.

DETAILED DESCRIPTION OF THE INVENTION

Figure 1:
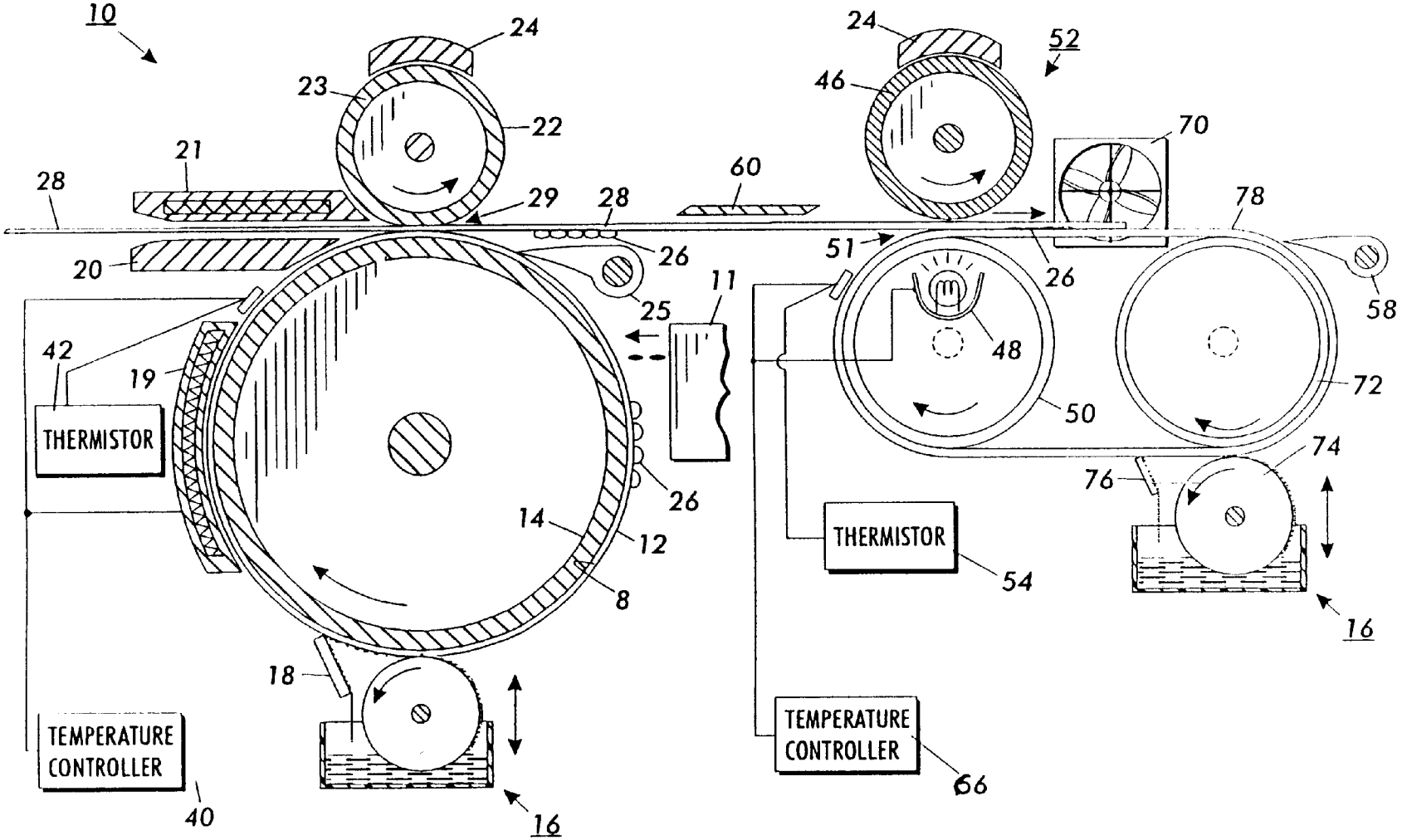
FIG. 1 is a diagrammatic illustration of present invention for applying a two-step transfer and fusing process in an ink jet printing system.

FIG. 1 discloses a diagrammatical illustration of an imaging system 10 in accordance with the present invention for applying a two-step transfer and fusing process whereby a hot melt ink is printed onto an intermediate transfer surface 12 for subsequent transfer to a receiving substrate. The receiving substrate is subsequently transported through a fusing subsystem for fusing the image to the receiving substrate. Referring to FIG. 1 wherein like numerals refer to like or corresponding parts throughout, there is shown a print head 11 having ink jets supported by appropriate housing and support elements (not shown) for either stationary or moving utilization to deposit ink droplets in image configuration onto an intermediate transfer surface 12. It will be understood that while the present invention is directed toward hot melt or solid based ink jet technology, various ink jet technologies may incorporate the two-step transfer-fusing process of the present invention.

For hot melt or solid ink based systems, the ink utilized is preferably initially in solid form and then changed to a molten state by the application of heat energy to raise the temperature from about 85 degrees to about 150 degrees centigrade. Elevated temperatures above this range will cause degradation or chemical breakdown of inks currently in use. The molten ink is then applied in raster fashion from ink jets in the print head 11 to the intermediate transfer surface 12 forming an ink image. The ink image is then cooled to an intermediate temperature and solidifies to a malleable state wherein it is transferred to a receiving substrate 28 such that the pixels are not spread and an initial matte finish is achieved. The image carrying receiving substrate is subsequently transported to a fusing subsystem for permanently fixing the image by spreading the pixels into the receiving substrate for a selected gloss finish. The details of this process will now be more fully described below.

In accordance with the present invention, the intermediate transfer surface 12 is provided in the form of a drum, as shown in FIG. 1, but may also be provided as a web, platen, belt, band or any other suitable design. The drum 14 may be fabricated out of any metallic material and most preferably is made from aluminum and polished to a high gloss. The intermediate transfer surface may also be coated with an elastomer layer 8, which defines a release surface. In addition, the intermediate transfer surface 12 may be coated with a liquid release layer applied to the drum 14 by contact with an applicator assembly 16, such as a liquid impregnated web, wicking pad, roller or the like. By way of example, but not of limitation, applicator assembly 16 comprises a wicking roller or pad of fabric or other material impregnated with a release liquid for applying the liquid and a metering blade 18 for consistently metering the liquid on the surface of the drum 14. Suitable release liquids that may be employed to coat the intermediate transfer surface 12 include water, fluorinated oils, glycol, surfactants, mineral oil, silicone oil, functional oils or combinations thereof. As the drum 14 rotates about a journalled shaft in the direction shown in FIG. 1, applicator assembly 16 is raised by the action of an applicator assembly cam and cam follower (not shown) until the wicking roller or pad is in contact with the surface of the drum 14. The release liquid, retained within the wicking roller or pad is then deposited on the surface of the drum 14. An exemplary intermediate transfer surface application system, and the details thereof, are fully disclosed in commonly assigned U.S. Pat. No. 5,805,191 to Jones et al., hereby incorporated by reference.

Referring once again to FIG. 1, the intermediate transfer surface 12 may be heated by an appropriate heater device 19. The heater device 19 may be a radiant resistance heater positioned as shown or positioned internally within the drum 14. In a preferred embodiment incorporating solid ink based ink jet technology, the heater device 19 increases the temperature of the intermediate transfer surface 12 from ambient temperature to between 25 degrees to about 70 degrees centigrade or higher for receiving the ink from print head 11. This temperature is dependent upon the exact nature of the liquid employed in the intermediate transfer surface 12 and the ink used and can be adjusted by providing an optimal temperature controller 40 in combination with a thermistor 42. Ink is then applied in molten form from about 85 degrees to about 150 degrees centigrade to the exposed surface of the intermediate transfer surface 12 by the print head 11 forming an ink image 26. The ink image 26 solidifies on the intermediate transfer surface 12 by cooling down to the malleable intermediate state temperature provided by heating device 19.

After the ink image is created on the intermediate transfer surface, the image is then transferred to a receiving substrate 28. In the illustrative embodiment of FIG. 1, a receiving substrate guide apparatus 20 transports the receiving substrate 28, such as paper or transparency, from a positive feed device (not shown) and guides it through a nip 29 formed between drum 14 and transfer roller 23. Thus, opposing arcuate surfaces of the transfer roller 23 and the drum 14 forms the nip 29. In one exemplary embodiment, the transfer roller 23 has a metallic core, preferably steel with an elastomer coating 22. The drum 14 continues to rotate, entering the nip 29 formed by the transfer roller 23 with the curved surface of the intermediate transfer surface 12 containing the ink image 26. The ink image 26 is then deformed to its image conformation and transferred to the receiving substrate 28 such that the pixels formed by the ink image on the receiving substrate are not spread creating an initial matte finish. The elastomer coating 22 on roller 23 engages the receiving substrate 28 on the reverse side to which the ink image 26 is transferred. In one embodiment the pressure in the nip 29 exerts a force less than about 800 lb/in$^2$ on the final receiving substrate 28.

In this process, the ink image 26 is first applied to the intermediate transfer surface 12 of the rotating drum 14 and then transfixed off onto the receiving substrate 28 having a pixel image. It should be understood that transfer efficiency can be enhanced by modifying characteristics that effect the nip 29 forming rollers to conform around the primary and secondary ink spots of the image and paper roughness of the receiving substrate 28. For example, a preferred thickness for the elastomer layer coating on the drum 14 in accordance with higher transfer efficiency is approximately between 40 to 200 microns. Conversely, it should also be understood that the nip 29 forming roller characteristics can be modified to enhance the manner in which the ink image spreads and flattens and is penetrated into the paper. For example, the preferred thickness of the elastomer layer previously defined in accordance with a higher drop spread is approximately between 5 to 40 microns. The ink image 26 is thus transferred to the receiving substrate 28 by the pressure exerted on it in the nip 29 formed by the drum 14 and roller 23. Stripper fingers 25 (only one of which is shown) may be pivotally mounted to the imaging apparatus 10 to assist in removing any paper or other final receiving substrate 28 from the exposed surface of the intermediate transfer surface 12.

In another embodiment, a heater 21 may be used to preheat the receiving substrate 28 prior to the transfer of the ink image 26. The heater 21 may be set to heat from between about 70 degrees to about 200 degrees centigrade. It is theorized that the heater 21 raises the temperature of the receiving medium to between about 90 degrees to about 100 degrees centigrade. However, the thermal energy of the receiving substrate 28 is preferably kept sufficiently low so as not to melt the ink image upon transfer to the receiving substrate 28. When the ink image 26 enters the nip 29 it is deformed to its image conformation and adheres to the receiving substrate 28 either by the pressure exerted against ink image 26 on the receiving substrate 28 or by the combination of the pressure and heat supplied by heater 21 and/or heater 19. In yet another embodiment, a heater 24 may be employed which heats the transfer roller 23 to a temperature of between about 25 degrees to about 200 degrees centigrade. Heater devices may also be employed in the paper or receiving substrate guide apparatus 20 and/or in the transfer and fixing roller 23, respectively. The pressure exerted on the ink image 26 must be sufficient to have the ink image 26 transfer to the receiving substrate 28 which may be between about 10 to about 2000 pounds per square inch, and more preferably between about 750 to about 850 pounds per square inch.

Figure 2:
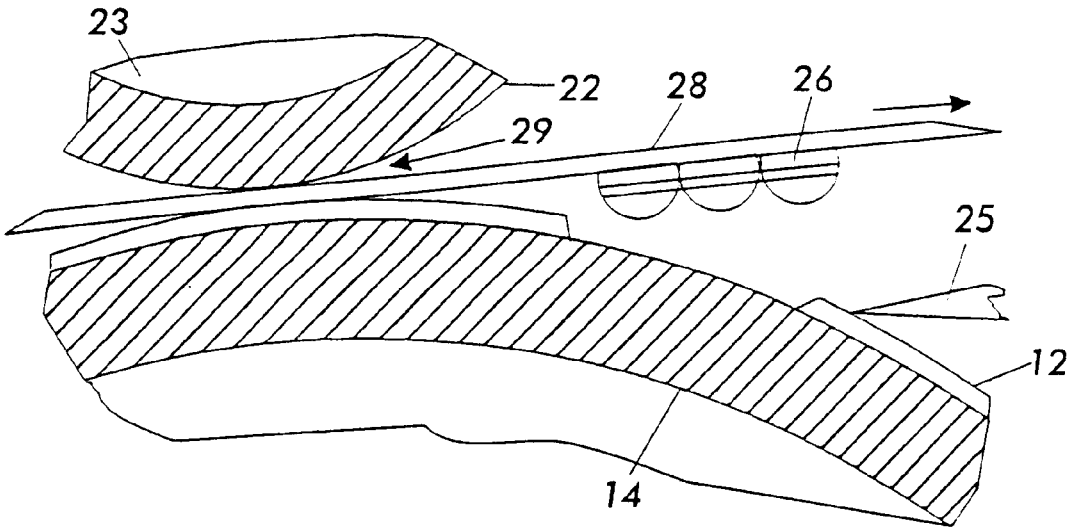
FIG. 2 is an enlarged diagrammatic illustration of the transfer of an ink image from an intermediate transfer surface to a receiving substrate for producing a matte finish.

FIG. 2 diagrammatically illustrates the sequence involved when the ink image 26 is transferred from the intermediate transfer surface 12 to the final receiving substrate 28 and more specifically, illustrates in detail the transfer mechanism that occurs when the liquid release layer is applied to the intermediate transfer surface 12. As seen in FIG. 2, the ink image 26 transfers to the receiving substrate 28 with a small, but measurable quantity of the liquid in the intermediate transfer surface 12 attached thereto as an outer layer. The average thickness of the transferred liquid layer is calculated to be about 0.8 nanometers. Alternatively, the quantity of transferred liquid layer can be expressed in terms of mass as being from about 0.1 to about 200 milligrams, and more preferably from about 0.5 to about 50 milligrams per page of receiving substrate 28. This is determined by tracking on a test fixture the weight loss of the liquid in the applicator assembly 16 at the start of the imaging process and after a desired number of sheets of receiving substrate 28 have been imaged.

After exiting the nip 29 created by the contact of the transfer roller 23 and the drum 14, the ink image can then be thermally controlled with a thermal device 60. This thermal device 60 can heat, cool, or maintain the temperature of the receiving substrate 28 and the ink image 26. The highest temperature the receiving substrate 28 and ink image 26 can be increased to in this location is dependent on the melting or flash point of the ink and/or the flash point of the receiving substrate 28. The thermal device 60 could be as simple as insulation to maintain the temperature of the ink and substrate as it exits the nip 29, or a heating and/or cooling system to add or remove thermal energy. By way of example only, the final receiving substrate may be heated to a temperature of between about 50° C. and about 100° C.

Figure 3:
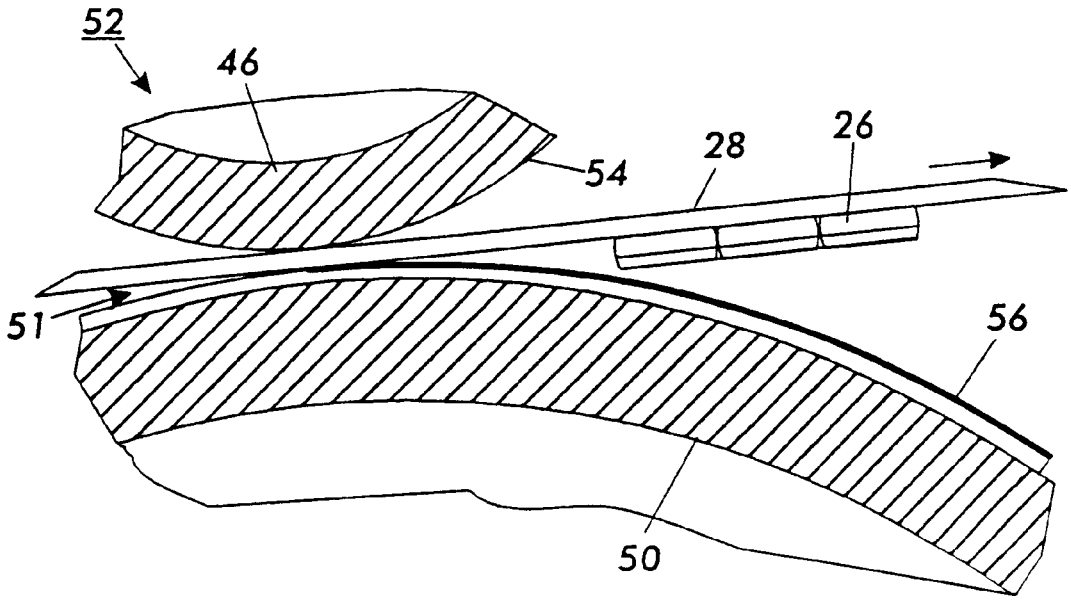
FIG. 3 is an enlarged diagrammatic illustration of the fusing of the ink image into the receiving substrate by a downstream fuser for producing a desired gloss finish in accordance with the present invention.

The receiving substrate 28 and ink image 26 are then transported to a fuser 52 to spread the pixels. Referring to FIG. 3, the fuser 52 may be composed of a back-up roller 46 which may have an elastomer coating 54 and a fuser roller 50. Either the back-up roller 46 or fuser roller 50 is a hard roller of highly polished aluminum or stainless steel with the other roller slightly harder then the transfer roller 23 having an elastomer coating 22 as shown in FIG. 2. This combination of fuser rollers creates a very small fuser nip 51 with very high pressures and can spread the pixels with a load of about 100 to 300lbs/in $^2$. The back-up roller 46 engages the receiving substrate 28 and ink image 26 on the reverse side to which the ink image 26 resides. This fuses the ink image 26 to the surface of the receiving substrate 28 so that the ink image 26 is spread, flattened, penetrated and substantially permanently adhered to the receiving substrate 28, as is shown in FIG. 3.

For a given load, changing the temperature of the fuser 52 changes the gloss on the image. The higher the temperature, the more glossy the images become. When the receiving substrate 28 and ink image 26 enter the fuser 52 their temperature will change as determined by the transient heat transfer of the system during the dwell in the fuser nip 51 formed by the fuser roller 50 and the back-up roller 46. Depending on the temperature of the back-up roller 46 and fuser roller 50, the transient temperature of the receiving substrate 28 and ink image 26 throughout their thickness can be controlled by either quenching or hot fusing, as will be described. If the receiving substrate 28 and ink image 26 are brought into the fuser nip 51 hotter than the fuser roller 50 and the back-up roller 46, the ink image 26 will be quenched to a cooler temperature. This is referred too as quench fusing. This is done by quenching the receiving substrate 28 and ink image 26 from a high temperature, say 80–85 centigrade down to a lower temperature, say 55–65 centigrade where the ink image 26 has enough cohesive strength to remain intact as it exits the fuser. Conversely, if the receiving substrate 28 and ink image 26 are brought into the fuser nip 51 cooler than the fuser roller 50 and the back-up roller 46, the ink image 26 will be heated to a higher temperature. This is referred to as hot fusing. This process allows pressure to be applied to the receiving substrate 28 and ink image 26 at temperatures unachievable in the transfer nip 29. By way of example only, the force in the second nip 51 exerts between about 400lbs/in $^2$ and about 2000lbs/in $^2$ on the final receiving substrate 28.

Additionally, the above fusing process may also be accomplished by heating the fuser nip 51 such that the ink image 26 near the surface of the receiving substrate 28 is hotter than the ink image near the surface of the fuser roller 50. This allows cool enough ink temperatures for release from the fuser roller 50 and higher temperatures near the receiving substrate 28, which increase spread, flattening, penetration and adhesion. The fuser roller 50 is provided in the form of a belt band or belt 78 traveling around a belt roller 72 and fuser roller 50. The receiving substrate 28 and ink image 26 are held against the belt 78 for a distance past the nip 51 formed by the belt and back-up roller 46, as will be more fully described below. This allows the ink sufficient time to cool to a temperature low enough to allow it to be stripped from the belt 78. It should be understood that the temperature of the fuser 52 can be different from that of the receiving substrate 28 and ink image 26 and may be controlled with a separate control system 56 which may include a heater 48, and thermistor 54, as is shown in FIG. 1.

Therefore, an advantage of the present invention is the ability to maintain a fuser at a different temperature than the ink and paper as well as the nip in which ink transfer to the paper occurs. For example, in prior art processes if the drum is too cold the ink will not transfer, spread, and penetrate the paper, and if the drum is too hot the ink will fracture and split resulting in incomplete image transfer. However, with the separate two-step transfer and fuse design of the present invention, the ink is already transferred onto the paper in the first nip (using the intermediate transfer surface at higher temperature and lower loads). If the fuser is at a lower temperature than the ink and paper it will be quenched in the fuser nip. Therefore, pressure can be applied to the ink and paper at higher temperatures without cohesively failing the ink (the ink will be quenched before it exits the fuser nip). Conversely, if the ink and media enter colder than the fuser nip it will be heated in the fuser nip.

In accordance with the present invention, the belt or band 78 is provided for quench fusing with a cooled length having cooling means such as a fan 70, as shown in FIG. 1 . The band 78 with the final receiving substrate 28 enters a hot secondary fuser nip 51 and the temperature distribution in the ink 26, band 78, and final receiving substrate 28 is controlled using the boundary conditions imposed by the fuser roller 50 and the transfix roller 50 instead of the initial conditions of the ink and substrate (a process named hot fusing). However, in this process, the final receiving substrate 28 is held against the band 78 along a cooling section after the fuse so that the ink layer can cool below the cohesive failure limit before stripping. Stripper fingers 58 (only one of which is shown) may be pivotally mounted to the fuser roller 50 to assist in removing any paper or receiving substrate from the surface of the fuser roller 50. The ink image 26 then cools to ambient temperature where it possesses sufficient strength and ductility to ensure its durability.

In addition, the belt or band 78 may be coated with a liquid release layer applied by a contact with a duplicate applicator assembly 16, such as a liquid impregnated web, wicking pad, roller or the like. By way of example, but not of limitation, applicator assembly 16 comprises a wicking roller 74 or pad of fabric or other material impregnated with a release liquid for applying the liquid and a metering blade 76 for consistently metering the liquid on the surface of the belt or drum 78. Suitable release liquids that may be employed to coat the belt or band 78 include water, fluorinated oils, glycol, surfactants, mineral oil, silicone oil, functional oils or combinations thereof. As the belt roller 72 rotates about a journalled shaft in the direction shown in FIG. 1, applicator assembly 16 is raised by the action of an applicator assembly cam and cam follower (not shown) until the wicking roller 74 or pad is in contact with the surface of the belt or band 78. The release liquid, retained within the wicking roller 74 is then deposited on the surface final receiving substrate 28 for applying a second coating to the final receiving substrate 28. The release agent prevents the ink image 26 on the final receiving substrate 28 to adhere to the surface of the belt or band 78 in the second nip 51.

This allows the use of temperatures in the fuser nip which are higher than the cohesive failure temperature of the ink/band combination. The fuser roller could be aluminum and the transfix roller some polymer similar to our current transfix rollers. The fuser requires heating by some source such as a halogen lamp. The "slow-band" architecture offers the possibility of low velocities and large cool-down lengths which would reduce the requirements on the cooling system.

In summary, the present invention utilizes an intermediate transfer surface for near perfect image transfer and a downstream fuser that is capable of operating at a temperature independent of the transfer step and more independent of the cohesive failure limits. It can also operate at possibly different pressures and/or different fusing speeds to allow different dwell times. The temperature, pressure, and dwell time control allow the level of the gloss to be adjusted and controlled. These two steps separate the requirements of ink transfer and ink spreading, topography, and penetration into the paper and will be easier to optimize for life than a single system that must perform both operations. Additionally, the two steps can be optimized individually to be smaller and cheaper than one more complex system while providing an opportunity to increase the durability of solid-ink by combining a very hot fuser temperature or a quench fuse independent of the transference process. The two-step system of the present invention also permits greater flexibility with respect to the speed at which the receiving substrate travels through the transfer and fusing process, thereby enabling higher paper output speeds from the imaging apparatus.

While the invention has been described above with reference to specific embodiments thereof, it is apparent that many changes, modifications and variations in the materials, arrangements of parts and steps can be made without departing from the inventive concept disclosed herein. Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

What is claimed is:

1. A method for continuous transfer and fusing in an ink jet printer, the method comprising the steps of:

a) forming an ink image on a intermediate transfer surface;

b) passing a final receiving substrate through a first nip;

c) exerting a first pressure on the final receiving substrate in the first nip to transfer the ink image from the intermediate transfer surface to the final receiving substrate, the first pressure being sufficient to transfer the ink image, but insufficient to fuse the ink image into the final receiving substrate;

d) passing the final receiving substrate through a second nip; and e) exerting a second pressure on the final receiving substrate in the second nip;

f) fusing the final receiving substrate at one or more temperatures in the second nip to fuse the ink image into the final receiving substrate and g) holding the final receiving substrate along a band allowing extending dwell times for increased cooling capabilities for facilitating hot fusing temperatures beyond the cohesive failure temperature of the ink.

2. The method of claim 1, wherein the step of passing the final receiving substrate through a second nip further comprises the step of passing the final receiving substrate between a fuser roller and back up roller.

3. The method of claim 2, wherein the step of fusing the final receiving substrate further comprises the step of quench fusing the final receiving substrate when the final receiving substrate is hotter than the fuser roller and the band.

4. The method of claim 2, wherein the step of fusing the final receiving substrate further comprises the step of quench fusing the final receiving substrate by use of a cooling fan.

5. The method of claim 1, further including the step of preheating the final receiving substrate.

6. The method of claim 2, wherein the step of fusing the final receiving substrate further comprises the step of applying a release agent to the final receiving substrate in the second nip.

7. The method of claim 1, wherein the step of exerting the first pressure comprises the step of exerting less than about 800 lbs/in $^2$ on the final receiving substrate.

8. The method of claim 1, wherein the step of exerting the second pressure comprises the step of exerting between about 400 lbs/in $^2$ and about 2000 lbs/in $^2$ on the final receiving substrate.

9. The method of claim 1, further including the step of heating the final receiving substrate to a temperature of between about 50° C. and about 100° C. after transferring the ink image to the final receiving substrate and prior to passing the final receiving substrate through the second nip.

10. The method of claim 1, further including the step of maintaining the first fuser roller at a temperature of between about 50° C. and about 100° C.

11. An apparatus for applying a two step transfix process in an ink jet printer, the printer having a print head mounted thereon for applying phase change ink image-wise to an intermediate transfer surface, the apparatus comprising: an applicator assembly connected to the printer adjacent to a support surface for distributing a liquid layer onto the support surface to produce the intermediate transfer surface; means for transferring the phase change ink from the intermediate transfer surface to a receiving medium; and a secondary fuser operating at one or more temperatures for processing the receiving medium having means for holding the final receiving substrate allowing extending dwell times for increased cooling capabilities for facilitating hot fusing temperatures beyond the cohesive failure temperature of the ink.

12. The apparatus as recited in claim 11 wherein the secondary fuser comprises a back-up roller and band.

13. The apparatus as recited in claim 11 wherein the secondary fuser comprises quench fusing the final receiving substrate by use of a cooling fan.

14. The apparatus as recited in claim 12 wherein the back-up roller and band comprise applying a release agent to the final receiving substrate in the second nip.

15. The apparatus as recited in claim 13 wherein the back-up roller and fuser belt comprise a control system consisting of a heating/cooling system and a thermistor for quenching and hot fusing capability.

16. The apparatus as recited in claim 15 wherein the media is held against the band which allows extended dwell times for increased cooling capabilities which facilitates increased hot fusing temperatures beyond the cohesive failure temperature of the ink.

17. The apparatus as recited in claim 11 wherein the applicator assembly further comprises a thermal device for maintaining the temperature of the receiving medium.

18. The apparatus as recited in claim 11, wherein the imaging apparatus further includes a heating means to melt a solid ink from the solid state to a molten state prior to the ejection from the ink jet print head.

19. The apparatus as recited in claim 11 in which the ink applied to the exposed surface of the liquid layer cools and solidifies to a malleable condition prior to transfer to the receiving medium.

20. A continuous transfer and fusing application system comprising:

means for forming an ink image on a intermediate transfer surface;

means for passing a final receiving substrate through a first nip;

means for exerting a first pressure on the final receiving substrate in the first nip to transfer the ink image from the intermediate transfer surface to the final receiving substrate, the first pressure being sufficient to transfer the ink image, but insufficient to fuse the ink image into the final receiving substrate;

means for passing the final receiving substrate through a second nip; and means for exerting a second pressure on the final receiving substrate in the second nip;

means for fusing the final receiving substrate at one or more temperatures in the second nip to fuse the ink image into the final receiving substrate; and means for holding the final receiving substrate along a fuser belt allowing extending dwell times for increased cooling capabilities for facilitating hot fusing temperatures beyond the cohesive failure temperature of the ink.

* * * * *